US005423730A

United States Patent [19]

Hirsch

[11] Patent Number: 5,423,730

[45] **Date of Patent: * Jun. 13, 1995**

[54] PHYSICAL FITNESS TRAINING APPARATUS AND METHOD OF USING

[76] Inventor: David E. Hirsch, 16 Sleepy Hollow, Orchard Park, N.Y. 14127

[ * ] Notice: The portion of the term of this patent subsequent to Dec. 4, 2007 has been disclaimed.

[21] Appl. No.: 866,826

[22] Filed: Apr. 10, 1992

Related U.S. Application Data

[63] Continuation-in-part of Ser. No. 599,037, Oct. 17, 1990, abandoned, which is a continuation of Ser. No. 341,029, Apr. 19, 1989, Pat. No. 4,974,836.

[51] Int. Cl.[6] ..... A63B 21/06

[52] U.S. Cl. ..... 482/92; 482/99; 482/904

[58] Field of Search ..... 482/92, 99, 102, 38, 482/39, 139, 904; 273/26 R, 26 B

[56] References Cited

U.S. PATENT DOCUMENTS

| | | | |
|---|---|---|---|
| 2,134,451 | 10/1938 | Mogren | 482/94 |
| 3,226,115 | 12/1965 | Zinderhill | 482/904 X |
| 3,531,115 | 9/1970 | Alexander | 273/260 |
| 3,652,085 | 3/1972 | Cole | 273/26 R X |
| 3,751,031 | 8/1973 | Yamauchi | 482/139 X |
| 4,111,414 | 9/1978 | Roberts | 482/39 |
| 4,229,002 | 10/1980 | Masters | 482/904 X |
| 4,328,964 | 5/1982 | Walls | 482/139 |
| 4,473,225 | 9/1984 | Miller | 482/40 |
| 4,620,704 | 11/1986 | Shifferaw | 482/121 |
| 4,846,471 | 7/1989 | Haysom | 272/26 R X |
| 4,887,584 | 12/1989 | Carella | 482/139 |
| 4,974,836 | 12/1990 | Hirsch | 482/97 |
| 4,984,786 | 1/1991 | Lemke et al. | 482/139 |
| 5,158,517 | 10/1992 | Steggert | 482/98 |

OTHER PUBLICATIONS

*Turn Your Arm Into A Rocket Launcher;* True Sport, Inc., Jan. 7, 1992.

*Primary Examiner*—Gene Mancene
*Assistant Examiner*—Jeffrey A. Smith
*Attorney, Agent, or Firm*—John C. Thompson

[57] ABSTRACT

A physical fitness training apparatus which may be readily installed in a door frame. The apparatus includes an extendable screw threaded support bar assembly (22) having rubber feet (28) at either end which may engage the sides of a door frame in an elevated position. Mounted on the support bar assembly are two radially outwardly extending eyes (52). A first pulley block (14) may be secured to one of the eyes (52) by a quick connector (60). A second pulley block (16) is provided and intermediate portions (74, 76) of a primary line (18) engage the sheaves (58) of each of the pulley blocks. The ends of the line are formed into eyes and one end (80) may be connected to the other radially outwardly extending eye (52) by means of another quick connector (60). A weight holder (12) is connected to an eye (56) on the second pulley block (16) by means of another quick connector (60). An engagement device is connected to the eye (78) on the other end of the line by another quick connector (60). The engagement device may be a baseball (88) with an extension length of line (86) or a baseball rotatably mounted within a yoke. Alternatively, it may be a cross bar (110) or ankle band (122).

The apparatus may be used for physical therapy and rehabilitation after injury or surgery, and also for physical training, such as for example in instructing a baseball player in the proper throwing technique.

2 Claims, 3 Drawing Sheets

Fig. 1.
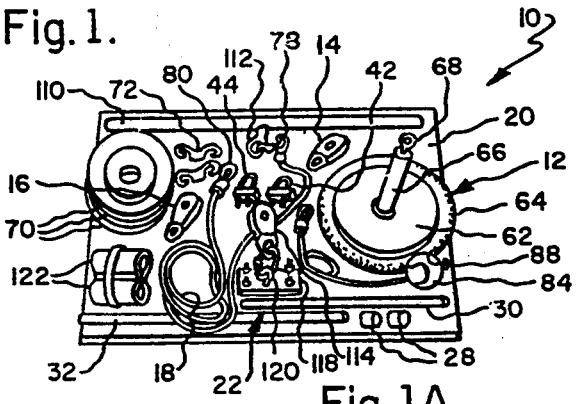
Fig. 1A.
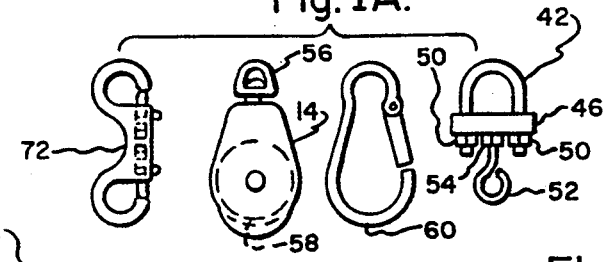
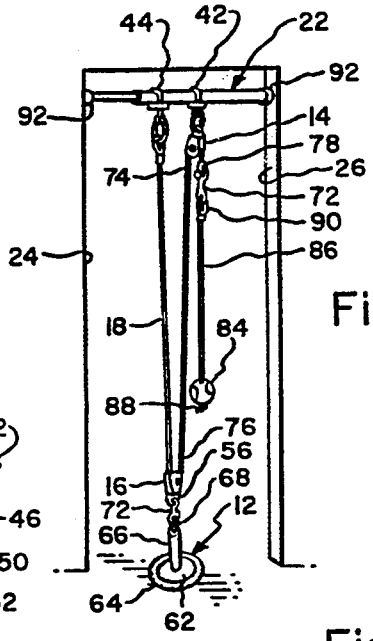
Fig. 2.
Fig. 4.
Fig. 5.
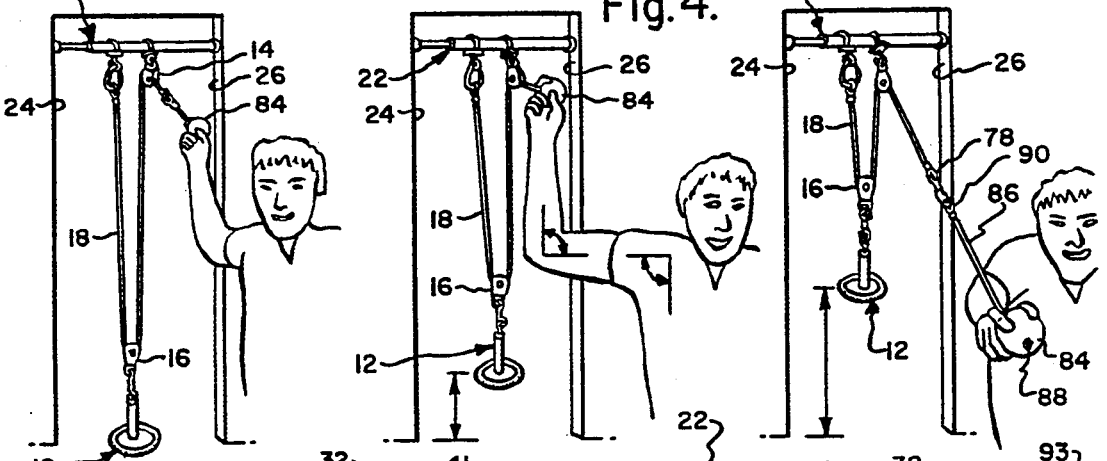
Fig. 3.
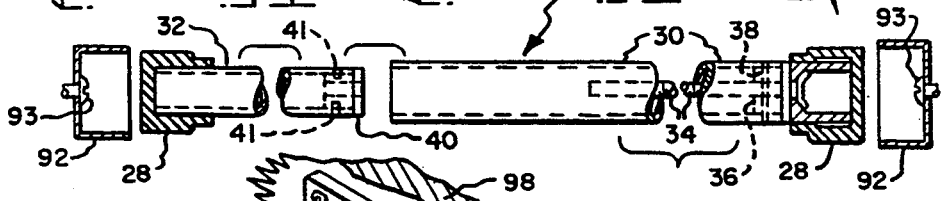
Fig. 2A.
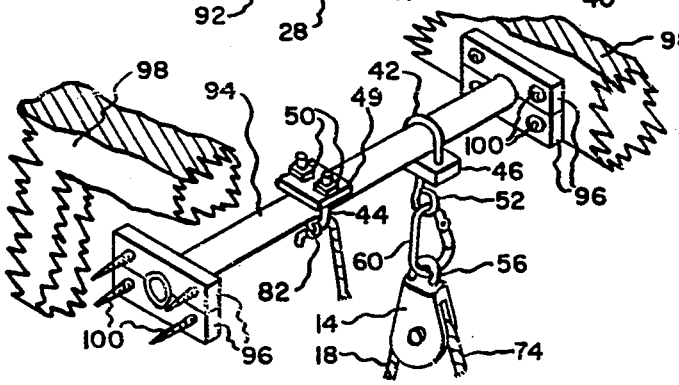
Fig. 6.

Fig. 7.
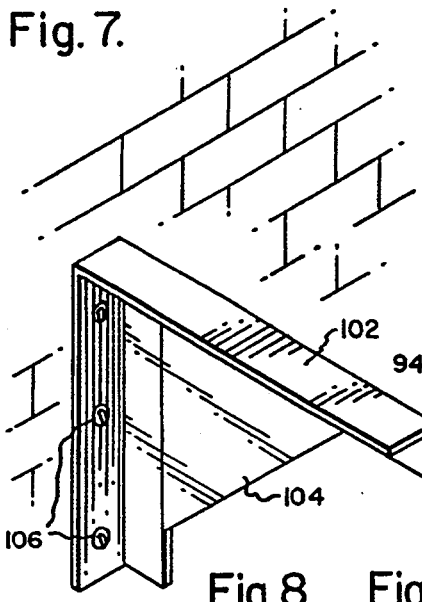
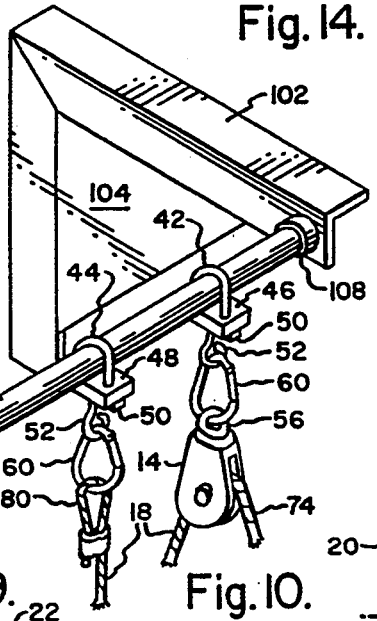
Fig. 14.
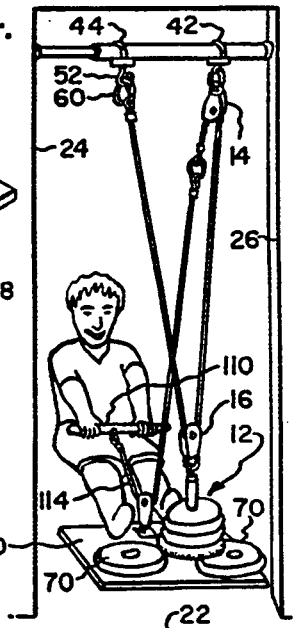
Fig. 8.
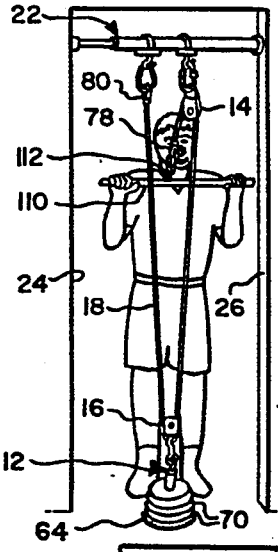
Fig. 9.
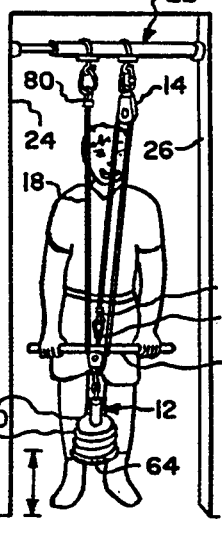
Fig. 10.
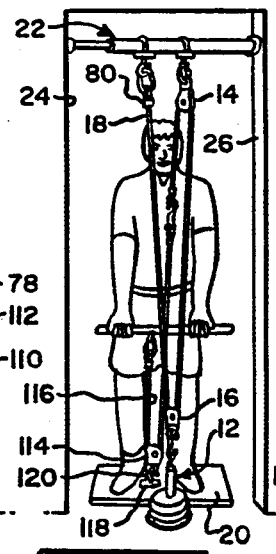
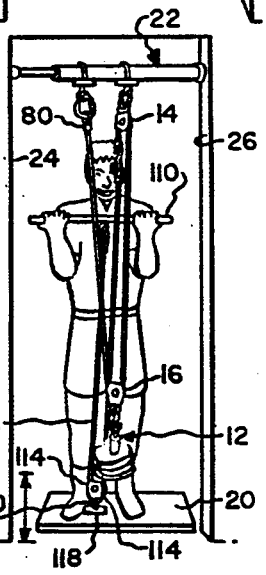
Fig. 11.
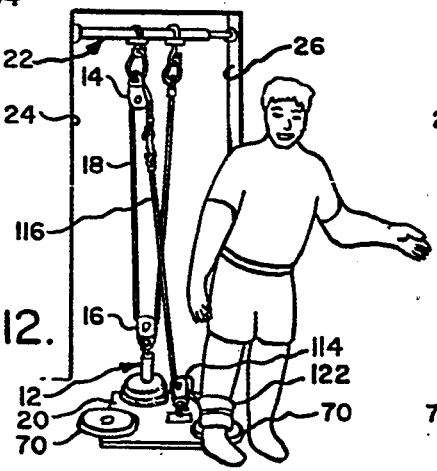
Fig. 12.
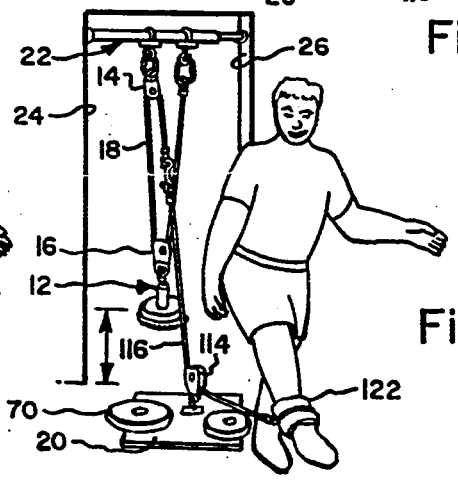
Fig. 13.

Fig. 15.
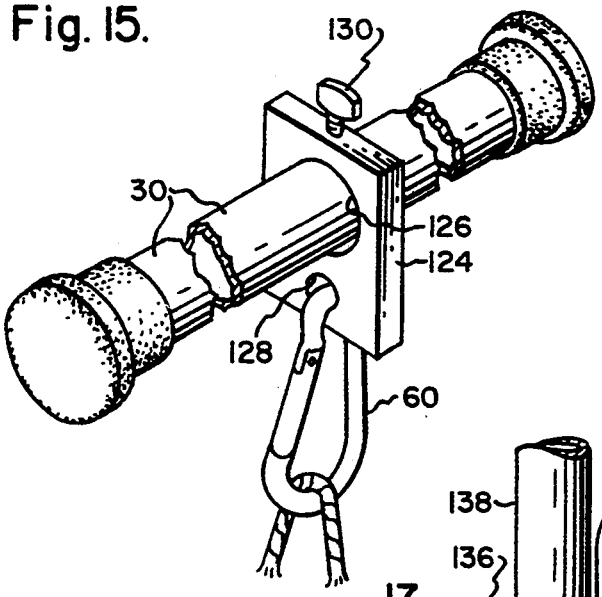
Fig. 17.
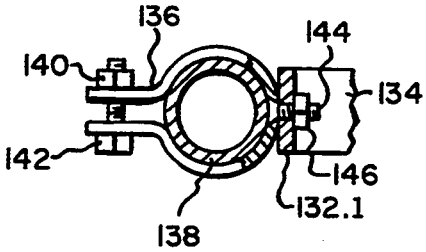
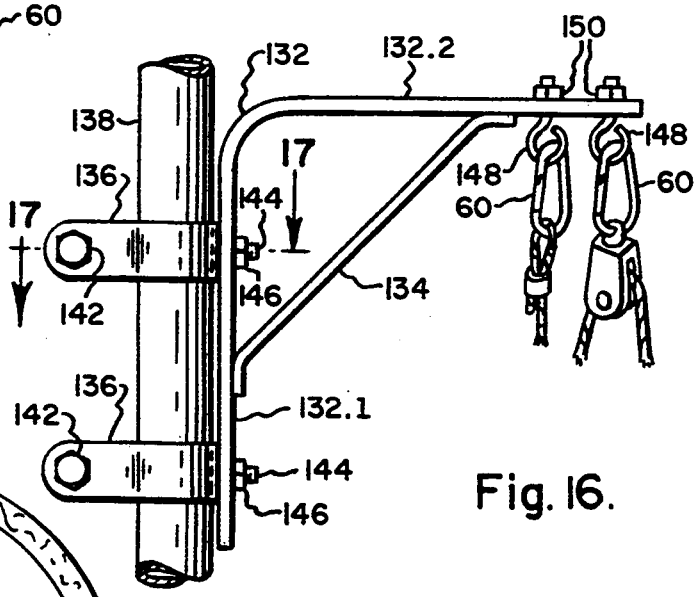
Fig. 16.
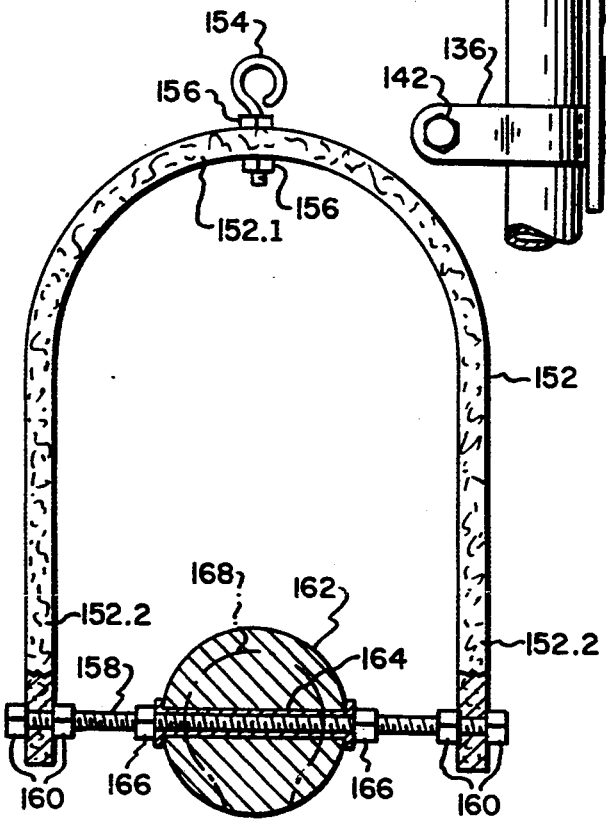
Fig. 18.
Fig. 19.
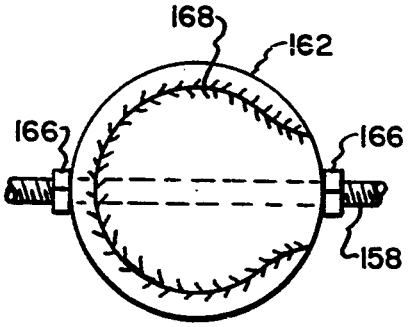

PHYSICAL FITNESS TRAINING APPARATUS AND METHOD OF USING

CROSS REFERENCE TO RELATED APPLICATIONS

This application is a continuation-in-part of applicant's prior U.S. patent application, application Ser. No. 07/599,037, filed Oct. 17, 1990, now abandoned which is in turn a continuation of applicant's prior U.S. patent application Ser. No. 341,029, filed Apr. 19, 1989, now U.S. Pat. No. 4,974,836 issued Dec. 4, 1990.

TECHNICAL FIELD

The present invention relates generally to physical fitness training apparatus which may be used for physical training, rehabilitation and therapy by resistance developed by utilization of pulley blocks and weights, and more particularly to an apparatus which may be broken down into a kit which is easily transported, and which apparatus may additionally be utilized for training a baseball player in the proper throwing motion.

BACKGROUND OF THE INVENTION

In the past, resistance apparatus of varying types have been developed. Thus, apparatus has been developed to facilitate training in various sports, such as in tennis, or hitting a baseball, and one such device is shown in U.S. Pat. No. 2,134,451. This device includes first and second pulley blocks, the first pulley block being mounted on a wall, a rope, cable or the like (herein after referred to as a line), the line having an intermediate portion which passes over the sheave in the first pulley block and which has one end secured to the first block, another intermediate portion of the line engaging the sheave on the second pulley block, which second pulley block carries a weight. A baseball bat or tennis racket may be secured to the free end of the line, and the swinging of the bat or racket is resisted by the weight carried by the second pulley block. This device has the disadvantages in that it must be more or less permanently secured to the wall, and it only has limited applications.

U.S. Pat. No. 4,109,907 disclosed a home exercise device which includes clip means for removable engagement over the upper edge of a door, which clip means supports pulley blocks to which weights and resistive training devices may be secured. While this device may be useful for its intended purposes, it lacks versatility and requires that a door be utilized.

It has been suggested that a resistance weight training device may be secured within a door frame and this is shown in U.S. Pat. Nos. 4,243,219 and 4,344,618. Neither one of these patents discloses a device which may be readily carried from one location to another. U.S. Pat. No. 4,619,453 also discloses a door frame resistance training device, but this device is unduly complicated.

U.S. Pat. No. 4,290,598 discloses a resistance or tension exerciser which may be supported from the joists of a ceiling.

Other apparatus has been developed for use in rehabilitation of injuries and for physical therapy. However, most rehabilitative apparatus is either very specialized, expensive, or both.

OBJECTS AND SUMMARY OF THE PRESENT INVENTION

It is an object of the present invention to provide a resistance weight device which overcomes the disadvantages of the prior art, which is readily portable, and which is utilized in ways not envisioned by the prior art.

It is one object of the present invention to provide a physical fitness training apparatus which is portable and which may readily be installed in a doorway, the apparatus including an extendable screw threaded support bar assembly having rubber feet at either end which may be mounted within a door frame in an elevated position at or near the top of the doorway, a line having an intermediate portion passing through a pulley carried by the bar assembly, a baseball secured to one end of the line, and resistance applying means supported by the line in such a manner that the resistance applying means will normally pull the 10 baseball towards the pulley with a constant force.

It is a further object of the present invention to provide a physical fitness training apparatus capable of being used to train a baseball player in the proper throwing motion and which may also be used for physical training, rehabilitation and therapy. The apparatus includes a baseball secured to one end of a line, an intermediate portion of the line passing over a first sheave in a first pulley block, there being resistance applying means capable of applying a resistive tension force to the line during the entire throwing motion of the baseball, the resistance applying means being a weight and a second pulley block which engage in another intermediate portion of the line between the second end of the line and the first pulley block, and support means capable of supporting the first pulley block at a height sufficiently high above the floor to permit a player to engage the ball and to go through a complete throwing motion including wind-up and follow through.

It is a still further object of the present invention to provide an apparatus of the type set forth above wherein the baseball is mounted in such a manner that it can rotate about it axis during the throwing motion.

It is another object of the present invention to provide a resistance weight training apparatus which may be utilized to train a baseball player in the proper throwing motion, the resistance training apparatus including a baseball which is secured to one end of a line, a length of the line immediately adjacent to the baseball being adapted to overlie a player's forearm at or near the completion of a throwing motion, the line in turn being secured by the means of pulley blocks in an elevated support to a weight which applies a resistive force to the baseball, preferably in the range of 2–8 pounds, or more.

The foregoing objects and other objects and advantages of the present invention will be more fully understood after a consideration of the following detailed description taken in conjunction with the accompanying drawings in which preferred forms of the present invention are illustrated.

BRIEF DESCRIPTION OF THE DRAWINGS

FIG. 1 is a perspective view of a resistance weight kit which embodies the principles of this invention.

FIG. 1A is an enlarged view of various of the elements of the kit shown in FIG. 1.

FIG. 2 shows how the kit of FIG. 1 may be assembled in a doorway when the kit is used as a training apparatus for training a baseball player or the like in the proper throwing motion.

FIG. 2A is an enlarged partially exploded view of the extendable screw threaded support bar assembly shown in FIG. 2.

FIGS. 3, 4 and 5 illustrate how the kit, when assembled in the manner shown in FIG. 2, may be utilized.

FIG. 6 illustrates a resistance weight apparatus mounted to ceiling joists, this view illustrating a modification of the kit shown in FIG. 1, and also illustrating a differing manner of securing various parts together.

FIG. 7 illustrates another modification of the resistance weight kit shown in FIG. 1, this view illustrating how an apparatus may be mounted to a wall.

FIGS. 8 through 11 illustrate how the resistance weight kit of FIG. 1 may be utilized in various arm exercises.

FIGS. 12 and 13 illustrate how the resistance weight kit of FIG. 1 may be utilized in a leg exercise.

FIG. 14 illustrates how the resistance weight kit may be utilized in a rowing exercise.

FIG. 15 is an enlarged partially exploded perspective view of the extendable screw threaded support bar assembly shown in FIG. 2 showing a differing structure for securing a pulley block or the end of a line to the support bar.

FIG. 16 illustrates another modification of the mounting structure for the weight training apparatus of this invention, which mounting structure may be secured to a back stop pipe.

FIG. 17 is a view taken generally along the line 17—17 in FIG. 16.

FIG. 18 is a view showing how the ball may be mounted in a yoke for rotational movement during throwing, the ball being mounted in such a manner that a player may grip the ball in the same manner as when throwing a fast ball.

FIG. 19 is a view showing a rotatable ball mounting, partially as shown in FIG. 18, but showing the ball rotated to a different position so that a ball player may be instructed how to grip the ball so that the ball will sail straight.

DETAILED DESCRIPTION

The resistance weight kit of this invention, which is indicated generally at 10, is shown unassembled in FIG. 1. In the preferred form illustrated the kit includes resistance applying means in the form of a weight holder indicated generally at 12, first and second substantially identical pulley blocks or swivel pulleys 14, 16, respectively, a primary line 18, engagement means in the form of a baseball 84, and additional weights and coupling devices. In addition, the kit may include a portable platform 20. The details of the kit will be more fully described below in connection with the various embodiments shown in FIGS. 2 through 5 and 8 through 14.

Referring now in greater detail to FIGS. 2 through 5, the kit has been assembled into a physical fitness training apparatus for a baseball player or the like, which apparatus may be used for training the player in the proper throwing motion, and which apparatus is also capable of being used in rehabilitation or physical therapy, as for example in building up the player's throwing arm. In this embodiment, support means, in the form of an extendable screw threaded support bar assembly, indicated generally at 22, is mounted between the sides 24 and 26 of a doorway. The support bar assembly 22 is provided with the rubber feet 28 at either end so that the sides of the doorway will not be marred when the support bar assembly is expanded to force the feet into engagement with the sides, and also to prevent the support bar assembly from sliding downwardly when a weight is applied to the bar. The extendable screw threaded support bar assembly is of conventional construction and includes first and second telescoping tubes 30, 32, a threaded rod 34 which is mounted in the first telescoping tube by a bushing 36 and roll pin 38, the threaded rod being received within an internally tapered circular nut 40 which is held within the second telescoping tube by suitable fasteners 41.

Supported on the first telescoping tube 30 are two spaced apart load carrying eyes. The eyes include two identical U-bolts 42, 44. The eyes include two identical mounting blocks 46 and 48 to which U-bolts 42, 44 may be secured, respectively, by nuts 50. Each of the mounting blocks or saddles is provided with a centrally located threaded aperture which receives a threaded eye bolt 52, which eye bolt is locked in place by suitable adhesives and nuts 54. While the U-bolts 42, 44 are removably secured to the first telescoping tube 30, it should be appreciated that eyes or equivalent apertured structures could be simply welded thereto or be otherwise suitably secured.

An alternate eye design is shown in FIG. 15. In this design a metal plate of 124 is utilized, the metal plate being provided with a large diameter aperture 126 which may receive the tube 30, and a smaller diameter aperture 128 which may receive one end of a cable or rope snap 60 (hereinafter, a line snap). The metal plate may be secured in place by a suitable set screw 130 which passes through a threaded aperture (no number) in the metal plate 124.

Each of the pulley blocks 14 is provided with a swivel eye 56 and a single sheave 58. The first pulley block 14 is secured to the eye 52 on the support 22 by means of a quick connector in the form of a line snap 60. Other suitable connectors may be utilized as will be apparent to those having ordinary skill in the art.

The weight holder 12 is adapted to be supported by the second pulley block or swivel pulley 16 and includes a plate metal disk 62 to which a heavy sponge rubber disk 64 of larger diameter is secured thereto by a suitable adhesive. Extending upwardly from the plate metal disk is a bar or shaft 66 which has an eye 68 secured to its upper end, the shaft 66 preferably being welded to the disk 62. By using this construction the weight holder may rest upon the floor, and, in the event that it starts to swing, the soft periphery of the rubber disk 64 will prevent injury to the door frame or any other object in which it might encounter. The weight holder has sufficient weight that it may be used without additional weights, particularly when first using the device as a throwing trainer. Additionally, by utilizing this form of construction additional weights in the form of aperture disks 70 may be stacked upon the planar portions of disk 62 to provide additional weight. The weight holder 12, with or without additional weights, is secured to the eye 56 of the second pulley block 16 by means of a quick connector, which for example may be a conventional double-ended snap latch 72.

The primary line 18 has first and second intermediate portions 74 and 76, respectively, passing over the sheaves of the first and second pulley blocks 14, 16. The first end of the line is provided with a first eye splice 78 and the second end is provided with a second eye splice 80. The eye splices may be formed by braiding, and it should be apparent that the ends of the line may be provided with rings or the like to facilitate their quick connections. Alternatively the end of the line may be secured in other ways. Thus, the second end of the line may be provided with a knot 82 as shown in example in FIG. 6, the second end of the line passing through the U-bolt 44 and being secured in place in the manner indicated. In this design a saddle block 49 is used which is not provided with a central aperture. However, in the preferred design, the second eye splice 80 is secured to the eye bolt 52 in the mounting block 48 by use of line snap 60. It should be noted that when the second end of the line is fixed, as for example in the manner indicated above, the load of the weight(s) and second pulley block will be equally distributed between the lengths of line to either side of the second pulley block when the weight is not in contact with the floor.

In the form illustrated in FIGS. 2 through 5, engagement means in the form of a baseball 84 is interconnected to the primary line 18. In order to facilitate the use of the apparatus with other engagement means, the primary line 18 does not extend all of the way to the baseball 84 but it is instead provided with the first eye splice 78 referred to above. An extension line 86 is actually secured to the baseball by the simple expedient of drilling a hole through the baseball, passing one end of the length of the extension line 86 through the ball, and forming a knot 88 on the end of the line. The other end of the extension line 86 is also provided with an eye splice 90 and this in turn is secured to the first eye splice 78 by means of another snap latch 72.

With the device illustrated in FIGS. 2 through 5 a baseball player can be instructed in the proper throwing motion. Thus, the player is instructed to engage the ball in his throwing hand with his arm in a back position and with the weight either in contact with the floor or just above the floor. Then the player is to bring his hand forward in a throwing motion until his arm is in a fully extended position as shown in FIG. 5. If the player does not maintain the right angle relationships between his forearm and upper arm and also between his upper arm and body as indicated in FIG. 4, the player will find that it is painful to throw the ball. Thus, by utilizing this device the player will be encouraged to properly throw the baseball. In addition, as resistance is applied by the weight holder, or any additional weights as desired, the effective weight varying from 2 to 8 pounds (or more) in the preferred range, the player will also be strengthening his arm. Thus, this device will encourage adjusting the throwing arm so that less strain is experienced in the shoulder joint by a correct feel concept, which varies slightly from person to person. In other words, the thrower's arm muscle and nervous system make instant adjustments in the throwing angle to achieve a proper feel, and this adjusted throwing angle provides the best mechanical advantage, putting the arm in the most efficient and safe throwing pattern.

This device is particularly useful to the beginning thrower, such as the Little League baseball player, where faulty habits can be corrected early. In addition, there is an application here also to the weekend player to avoid wrong throws and to avoid injury to the arm. This device would also be useful in eliminating the already developed faulty throw patterns of high school, college and professional baseball players. In addition, it may be used in warm-up drills in the dugout and can also be used in a 10 rehabilitation program following injury or surgery or for other forms of physical therapy.

As can be seen from the above, the preferred form of this invention is readily portable and can be easily assembled in one's room while traveling. Thus, the preferred support is the portable, easily installed extendable screw threaded support bar assembly 22 illustrated in FIGS. 2 through 5. However, other forms of support may be utilized, which forms may involve more or less permanent mountings. As shown in FIG. 2A, caps 92 may be provided, each cap being capable of receiving an associated rubber foot 28, and the caps being secured to the door frame by screws 93. This design permits more weight to be carried by support 22.

In the design shown in FIG. 6, a short length of pipe 94 is supported by lower saddle brackets 96 which are secured to adjacent faces of adjacent joists 98 by screw threaded fasteners 100. Upper saddle brackets 101 may also be used.

An alternate embodiment to FIG. 6 is shown in FIG. 7 where L-shaped brackets 102, which are suitably reinforced by gussets 104, are utilized. The L-shaped brackets are secured to a wall or the like by fasteners 106. As can be seen the L-shaped brackets are preferably made of angle iron, adjacent faces of the angle iron having welded thereto tubular portions 108 which can receive a length of pipe 94 of the same type as utilized in FIG. 6.

In FIG. 16 a single L-shaped support bracket 132 is shown, this bracket being reinforced by a brace 134. The vertical leg 132.1 of the L-shaped bracket is suitably apertured, and fasteners hold conventional pipe clamps 136, which clamps may be secured about a back stop fencing pipe 138 by nuts 140 and bolts 142. As shown in FIG. 17 each of the pipe clamps is in turn secured to the vertical leg 132.1 of the L-shaped bracket by suitable fasteners 144 and nuts 146. Eye bolts 148 are in turn secured to the horizontal portion 132.2 of the L-shaped bracket by nuts 150. Line snaps 60 may in turn be secured to the eyes 148, and the line snaps may in turn receive a pulley block or a rope or cable eye, as shown in FIG. 7, or any other suitable connector. If the pipe clamps 136 are removed, the support bracket may be secured directly to a wall by using suitable fasteners which pass through the apertures in legs 132.1 which receive the fasteners 144, or other suitable apertures, not shown.

While FIGS. 3 through 5 illustrate the resistance weight kit of the present invention for use by the baseball player of the like, it should be apparent that the kit of the present invention can be assembled in differing manners for other uses. Thus, for example, in FIGS. 8 and 9 an upper arm pull down exercise is illustrated wherein an engagement means in the form of a cross bar 110 is secured to the first eye splice 78 on the line. Thus, the cross bar 110 has a centrally located radially outwardly extending eye 112, the eye 112 being secured to the first eye splice 78 by means of a line snap 60. In this embodiment more weight is applied to the weight holder 12 by adding the additional weights 70.

In FIGS. 10 and 11 another form of arrangement is illustrated which utilizes the platform 20. The platform is provided with a third pulley block 114 through which an intermediate portion of a length of an extension line 116 passes, the length of line 116 being provided with eye splices at either end. The third pulley block is secured to the platform by a base plate 118 which is bolted or otherwise rigidly secured to the platform, the base plate having an upwardly extending eye 120 which is secured to the eye 56 on the third pulley block by another line snap 60. It can be appreciated from an inspection of FIGS. 10 and 11 that the platform 20 has a sufficient width so that someone may stand upon it.

The embodiment shown in FIGS. 12 and 13 illustrate how the kit may be assembled so that a leg training exercise or the like may be performed. In this embodiment the various parts are arranged in essentially the same manner as they are in FIGS. 10 and 11 except that a number of additional weights 70 are placed upon the platform 20, the additional weight at least equaling the weight of the weight holder 12 and the additional weight 70 carried thereon. The end of the extension line 116 remote from the first line 18 is secured to the ankle band 122. It can be seen by utilizing this device that various leg strengthening exercises or the like may be performed.

With respect to FIG. 14, it can be seen that a rowing exercise may be performed by the apparatus when assembled in the manner shown in FIGS. 10 and 11 with additional weights being placed upon the platform in the same manner as indicated in FIGS. 12 and 13.

Finally, with respect to FIGS. 18 and 19, a different structure is shown for mounting the baseball to the line 18. In this case, instead of the baseball being connected to the primary line 18 by an extension line 86, it is in turn connected to the primary line by means of a yoke 152, the yoke being provided with an eye 154 at its bight portion 152.1, the eye in turn being secured by nuts 156. Extending between spaced apart legs 152.2 of the yoke is a threaded rod which is received in suitable apertures in the legs 152.2. The threaded rod is held in place by suitable end nuts 160. A baseball 162 is provided which has ferrule 164 extending through the baseball, the ferrule being provided with flanged end portions which abut against the baseball. The threaded rod 158 passes through the ferrule and the baseball is kept from sliding upon the rod by suitable fasteners such as lock nuts 166. By using the mounting structure shown in FIG. 18, the baseball 162 is free to rotate. The baseball may be mounted in such a manner that the stitching will be position as shown in phantom lines 168. This will permit the baseball player to engage the ball and throw it in the manner that he should throw it when throwing fast balls. Alternatively, the baseball may be mounted as shown in FIG. 19 with the stitching rotated 90 degrees. This is the desired position for throwing the ball by a fielder so that the ball will sail straight.

In conclusion, it should be noted that the present invention simulates regular pitching and throwing, but with added resistance. It is well recognized that resistance training is conducive to muscular strength development. With the device of this invention, strength development occurs in many of the same muscles used for pitching and throwing, not only in the arm, but also in the trunk and legs. Consequently, as strength increases, the potential to be a more effective pitcher or thrower increases as well. The present device also has value in the area of conditioning/rehabilitation. The prescribed rotator cuff exercises of Dr. Jobe can be applied quite effectively with this device. Other exercises can also be effectively carried out.

While a resistance weight kit has been disclosed, and while differing support mechanisms have also been disclosed, it should be noted that other forms of apparatus may be employed in the practice of the broader aspects of this invention. Therefore, while preferred structures in which the principles of the present invention have been incorporated have been shown and described above, it is to be understood that this invention is not to be limited to the particular details shown and described above, but that, in fact, widely differing means may be employed in the practice of the broader aspects of this invention. For example a single pulley system may be utilized if only a limited throwing motion is acceptable. Alternatively, a double pulley system may be utilized if a greater range of throwing motion is desired.

What is claimed is:

1. A physical fitness training apparatus capable of being used to train a baseball player or the like in the proper throwing motion, and which may also be used to build up the player's throwing arm by simulating the player's throwing motion, for therapy, and for rehabilitation; the apparatus comprising:

a baseball provided with a hole extending all of the way through the baseball;

a first pulley block including a first sheave;

a line having first and second ends, a first intermediate portion of the line passing over the first sheave of the first pulley block;

a yoke, the first end of the line being connected to the bight portion of the yoke, the yoke further including a shaft which passes through the hole in the baseball in such a manner that the ball can rotate about the shaft;

resistance applying means engaging the line between the first intermediate portion of the line and the second end of the line and capable of applying a resistive tension force to the line during the entire throwing motion, the resistance applying means being a weight; and support means disposed at a location above the floor a distance sufficient to permit a player to engage the ball and go through a complete throwing motion including windup and follow-through.

2. A physical fitness training method for training a baseball player in the proper throwing motion, the method comprising the following steps:

providing a baseball having a hole extending all the way through the baseball;

providing a line, an intermediate portion of the line passing over a sheave within a pulley block and having a weight interconnected with the line;

providing a yoke, the bight portion of the yoke being connected to the first end of the line, and the yoke further including a shaft which passes through the hole in the baseball in such a manner that the ball can rotate about the shaft, the weight applying a constant resistance force to the baseball in the range of 2–8 pounds, or more, the pulley block being disposed at an elevation sufficiently high so that when the baseball is grasped in the player's hand and the player's forearm is in a completed throwing position the length of the line adjacent to the player's forearm will be in close proximity to the forearm; and instructing a player to throw the four seam fast ball pitch with a full range of motion.

* * * * *